US005305772A

United States Patent [19]

Lai

[11] Patent Number: 5,305,772

[45] Date of Patent: Apr. 26, 1994

[54] STRUT STRUCTURE OF A FOLDING UMBRELLA HAVING A SEAMLESS UMBRELLA COVER

[76] Inventor: Chen M. Lai, F38, 3rd Fl., 5, Shin Yi Rd., Taipei, Taiwan

[21] Appl. No.: 134,100

[22] Filed: Oct. 12, 1993

[51] Int. Cl.[5] ..... A45B 25/18

[52] U.S. Cl. ..... 135/33.4; 135/31; 135/33.41

[58] Field of Search ..... 135/29, 31, 33.2, 33.4, 135/33.41, 37

[56] References Cited

U.S. PATENT DOCUMENTS

| | | | |
|---|---|---|---|
| 588,773 | 8/1897 | Mitchell | 135/33.41 |
| 2,087,756 | 7/1937 | Farkas | 135/33.4 X |
| 2,125,078 | 7/1938 | Maxwell, Jr. | 135/33.4 |
| 2,453,270 | 11/1948 | Russell | 135/33.4 |
| 5,063,953 | 11/1991 | Wu | 135/31 X |
| 5,226,438 | 7/1993 | Dubinsky | 135/33.4 |

FOREIGN PATENT DOCUMENTS

| | | | |
|---|---|---|---|
| 1431627 | 1/1966 | France | 135/33.41 |
| 0570802 | 7/1945 | United Kingdom | 135/33.4 |
| 0677870 | 8/1952 | United Kingdom | 135/33.4 |

*Primary Examiner*—Carl D. Friedman
*Assistant Examiner*—Lan C. Mai
*Attorney, Agent, or Firm*—Morton J. Rosenberg; David I. Klein

[57] ABSTRACT

The invention relates to a strut structure of a folding umbrella having a seamless umbrella cover, which structure makes use of an integrally molded fastener with an open groove provided on the hollow cylindrical body thereof to fix the umbrella cover on the strut. The outside diameter of the strut is slightly smaller than the hole diameter of the fastener and slightly larger than the width of the open groove and so the fastener can be directly pushed inwards from the outside to clamp the strut as well as the umbrella cover, forming a firm engagement. As a result, when the folding umbrella is closed, the umbrella cover made of a single cloth folds inwardly as well for storage.

3 Claims, 15 Drawing Sheets

STRUT STRUCTURE OF A FOLDING UMBRELLA HAVING A SEAMLESS UMBRELLA COVER

BACKGROUND OF THE INVENTION

The connections between an umbrella cover and struts in a prior art are principally by stitching the umbrella cover to ends and joints of struts so that the umbrella cover can cling to struts as opening or closing the umbrella, resulting in a nice-looking appearance and convenience of storage. However, the sewing method, largely depending on manpower, takes so much time and money that it seems to be not economical and impractical for production in a country that is thirsty for laborers. Furthermore, for an umbrella cover made of a single cloth that does not have tacks for stitching or PVC cloth that lacks of strength for stitching, stitching is not a feasible method for the production of folding umbrellas having such covers. Consequently, so far there are not on the market folding umbrellas that use a single cloth or PVC cloth as umbrella covers.

SUMMARY OF THE INVENTION

In view of that, the primary object of the invention is to provide a strut structure of a folding umbrella having a seamless umbrella cover, which strut structure makes use of an integrally molded fastener with an open groove formed on one side of the fastener body to fix the cover on struts. The specially designed fasteners can be directly pressed into the strut from the outside and so the strut structure of the invention may be assembled by minimum manpower or automatic production, achieving an effect of production automation.

The structure, features, and advantages of the invention will become apparent by reference to the following description taken in conjunction with the accompanying drawings.

BRIEF DESCRIPTION OF THE DRAWINGS

FIGS. 8 and 8-1 illustrate the embodiments of the strut structure used in varied umbrellas according to the invention.

FIGS. 9, 9-1, 9-2, 9-3, 9-4, and 9-5 indicate the embodiments of the strut structure used together with various umbrella covers.

DETAILED DESCRIPTION

Figure 1:
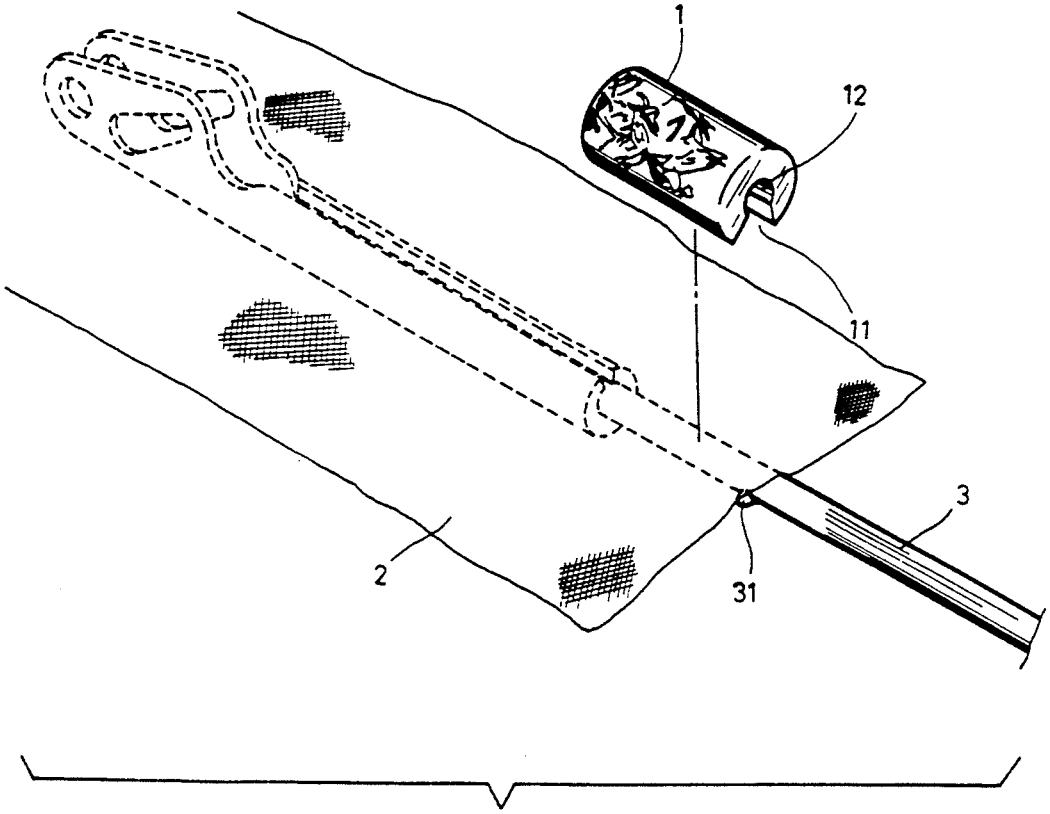
FIG. 1 is a perspective view showing the parts of an embodiment of a strut structure according to the invention.
Figure 2:
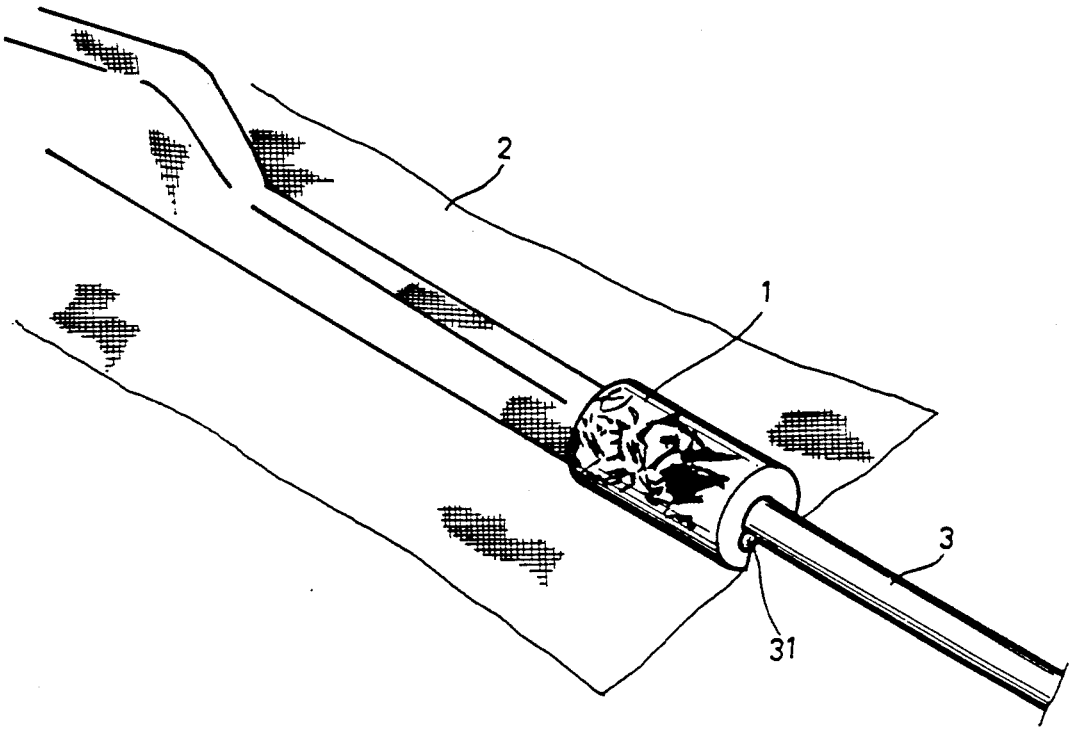
FIG. 2 is an assembly drawing of the strut structure shown in FIG. 1.
Figure 3:
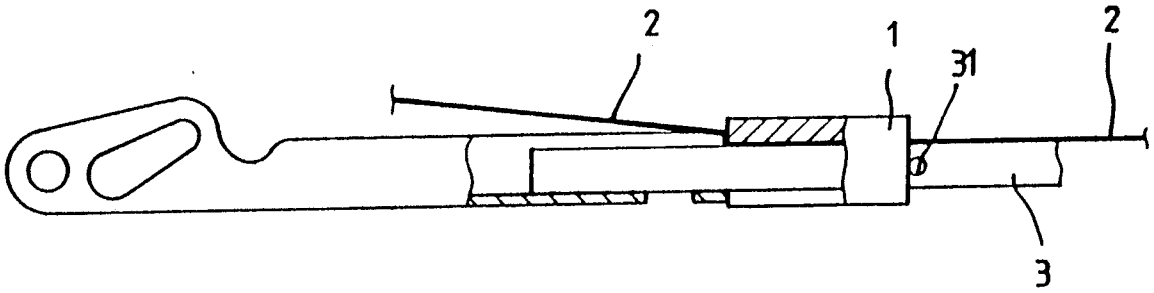
FIG. 3 is a partial cross sectional view along the longitudinal axis of the strut structure of FIG. 2.

As can be seen in FIGS. 1 to 4, the invention is mainly concerned with a strut structure that comprises a fastener (1) specially designed to fix an umbrella cover (2) made of a single cloth on struts (3). The fastener (1) is molded in an integral form and further configurated to have a hollow cylindrical body with an inside diameter (12) slightly larger than the outside diameter of the strut (3) and an open groove (11) provided on one side of the cylindrical body, with an opening width slightly smaller than the outside diameter of the strut (3). The fastener (1) is made of a moldable resilient material and used as follows. The struts (3) of an umbrella are at first covered by an umbrella cover (2), and a fastener (1) is placed on the top of the umbrella cover, with the opening of the groove (11) sitting opposite a strut (3). With such an arrangement, the fastener (1) is directly pressed inwards from the outside to clamp the strut (3) with the umbrella cover sandwiched therebetween, forming a firm engagement. In addition, projections (31) are formed on struts (3) to hold fasteners (1) in proper positions, preventing longitudinal movement.

After many such fasteners (1) promptly fix the umbrella cover (2) on struts (3), the umbrella's cover (2) firmly sticks to struts (3) without loosening.

Figure 5:
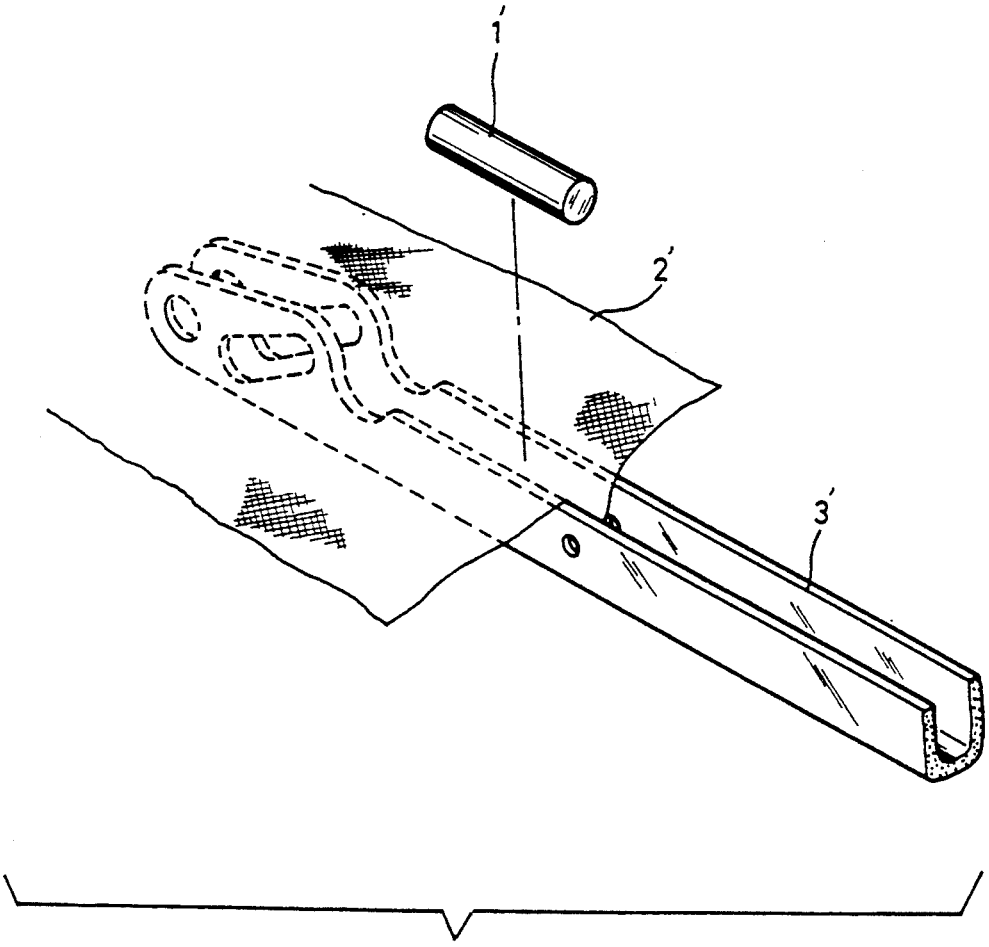
FIG. 5 is a perspective view indicating the parts of another embodiment of a strut structure according to the invention.
Figure 6:
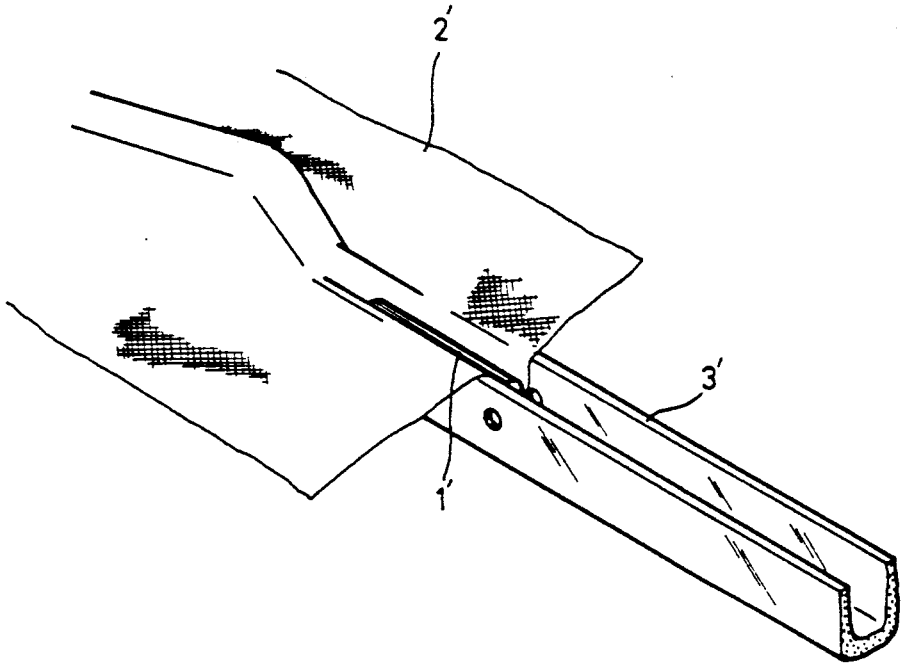
FIG. 6 is an assembly drawing of the strut structure shown in FIG. 5.
Figure 7:
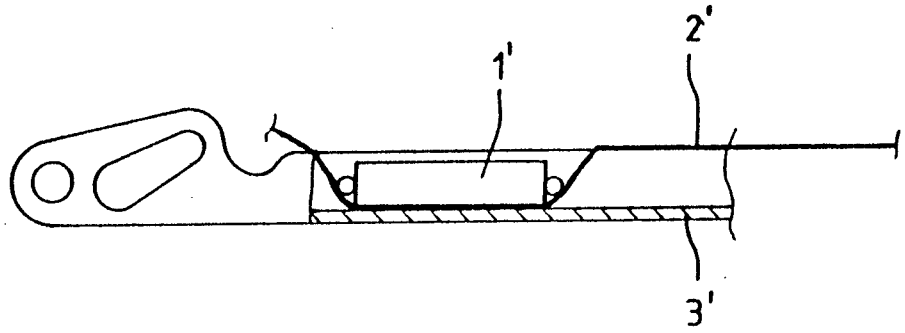
FIG. 7 is a partial cross sectional view along the longitudinal axis of the strut structure of FIG. 6.

In another embodiment of a strut structure of the invention shown in FIGS. 5 to 7, the strut (3') is substantially U-shaped with the opening facing up. The fastener (1') is a cylindrical body with an outside diameter approximately equal to the width of the U-shaped groove so that when it is put into the U-shaped groove the umbrella cover (2') is clamped between the fastener (1') and the bottom of the U-shaped groove, incapable of escaping from the groove.

Figure 8:
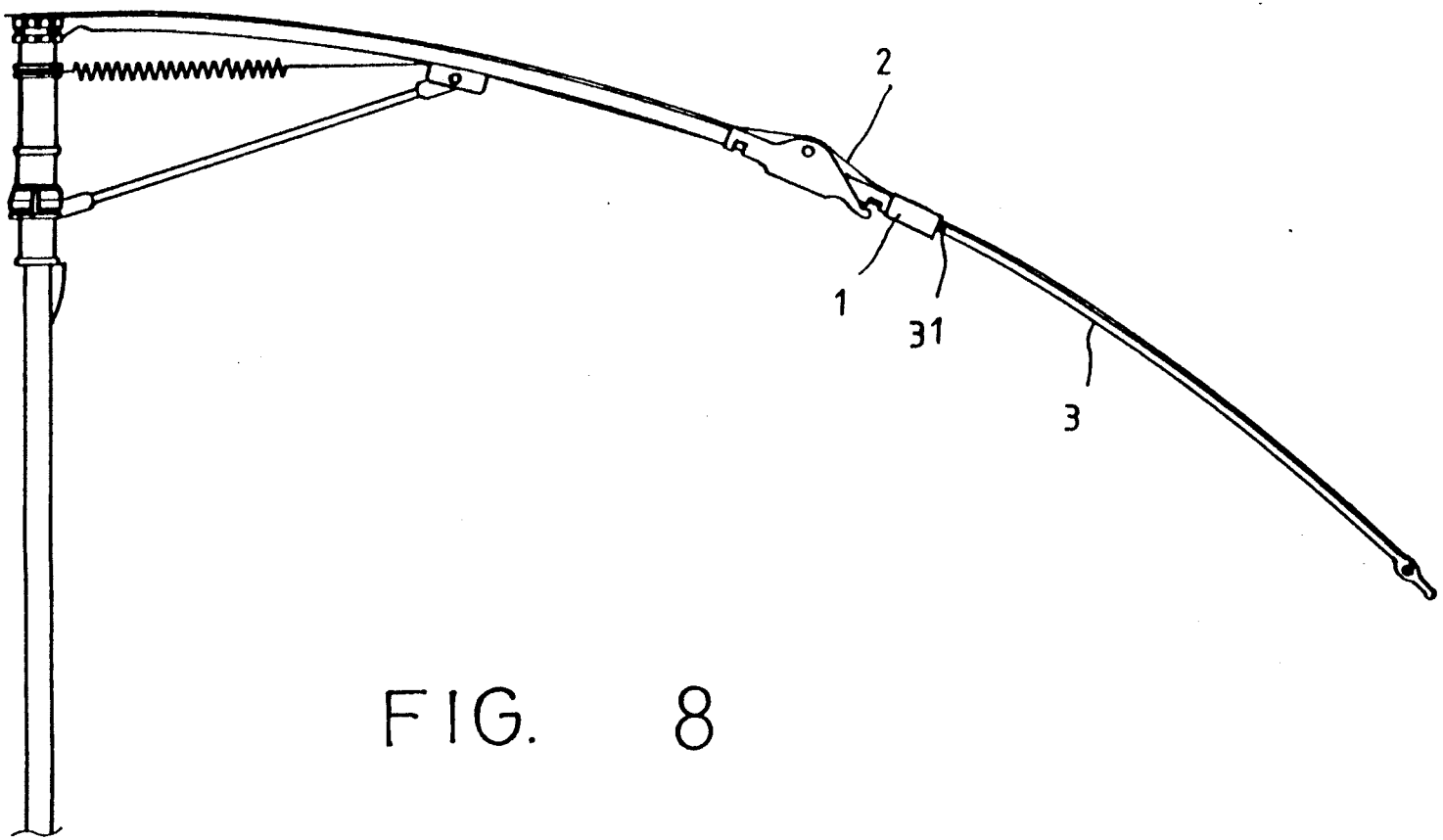
Figures 1, 8:
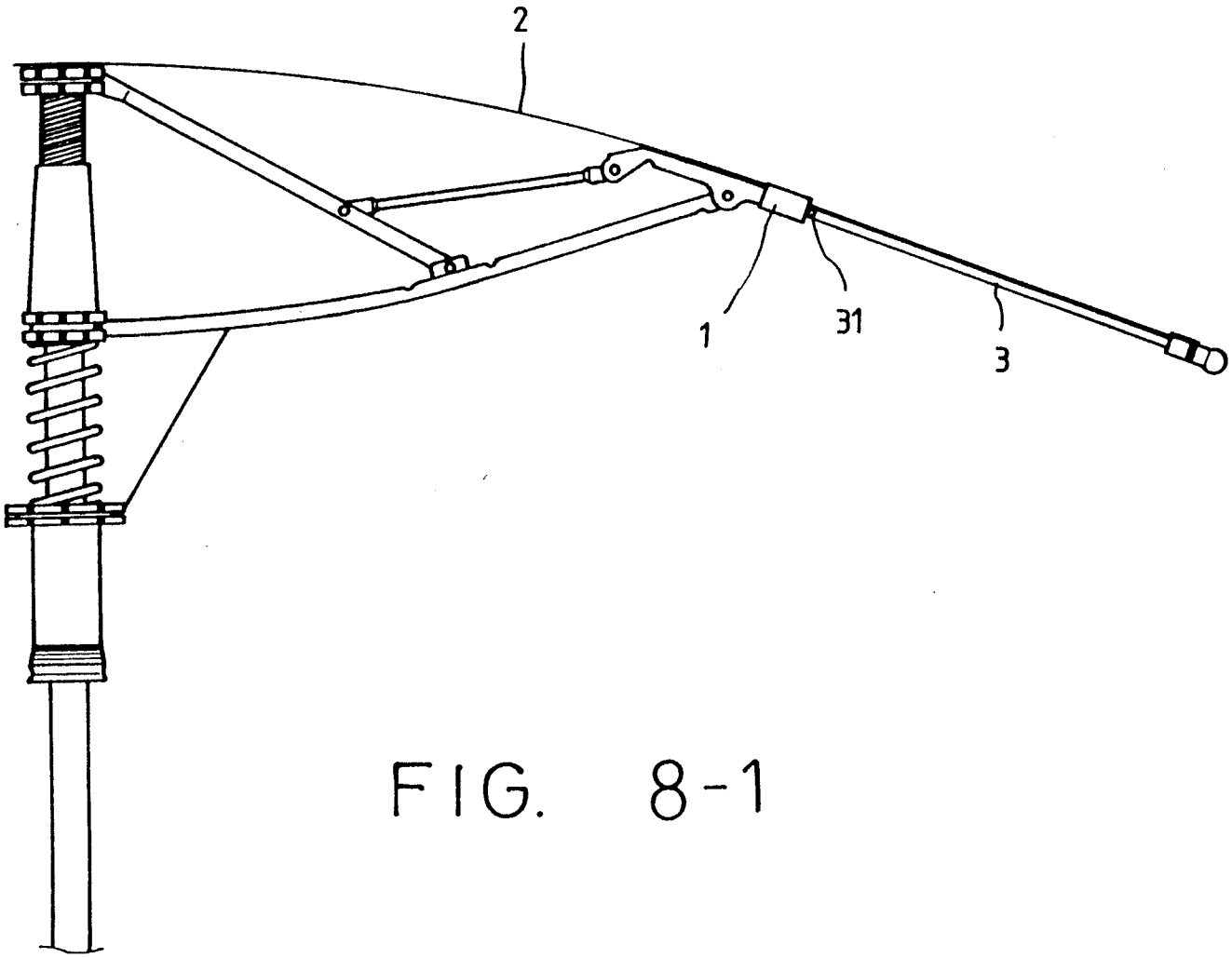

FIGS. 8 and 8-1 are elevation views showing the applications of the invention in struts of two different types.

Figure 4:
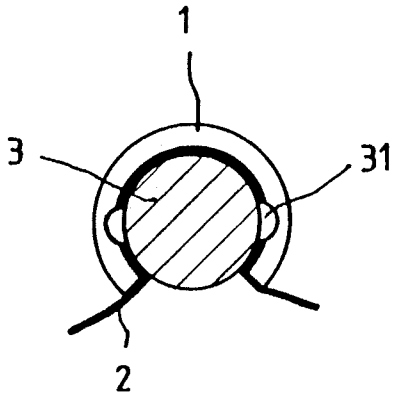
FIG. 4 is another cross sectional view along a plane orthogonal to the longitudinal axis of the strut structure of FIG. 2.
Figure 9:
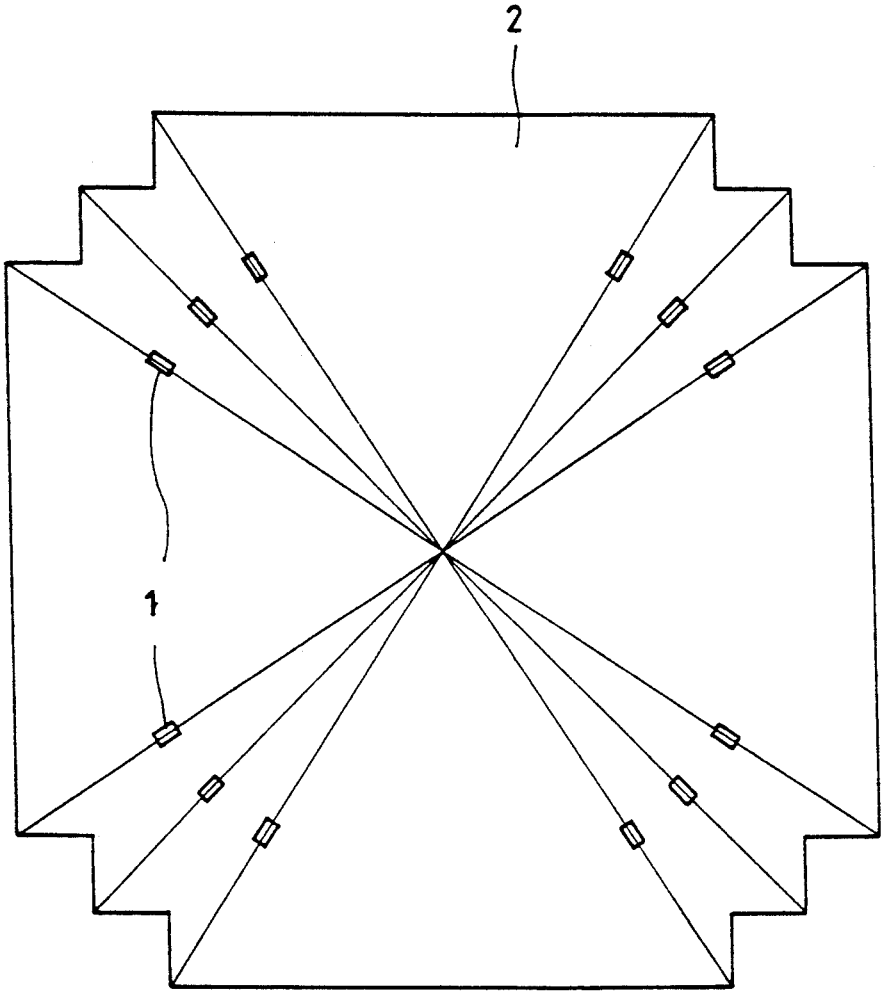
Figures 1, 9:
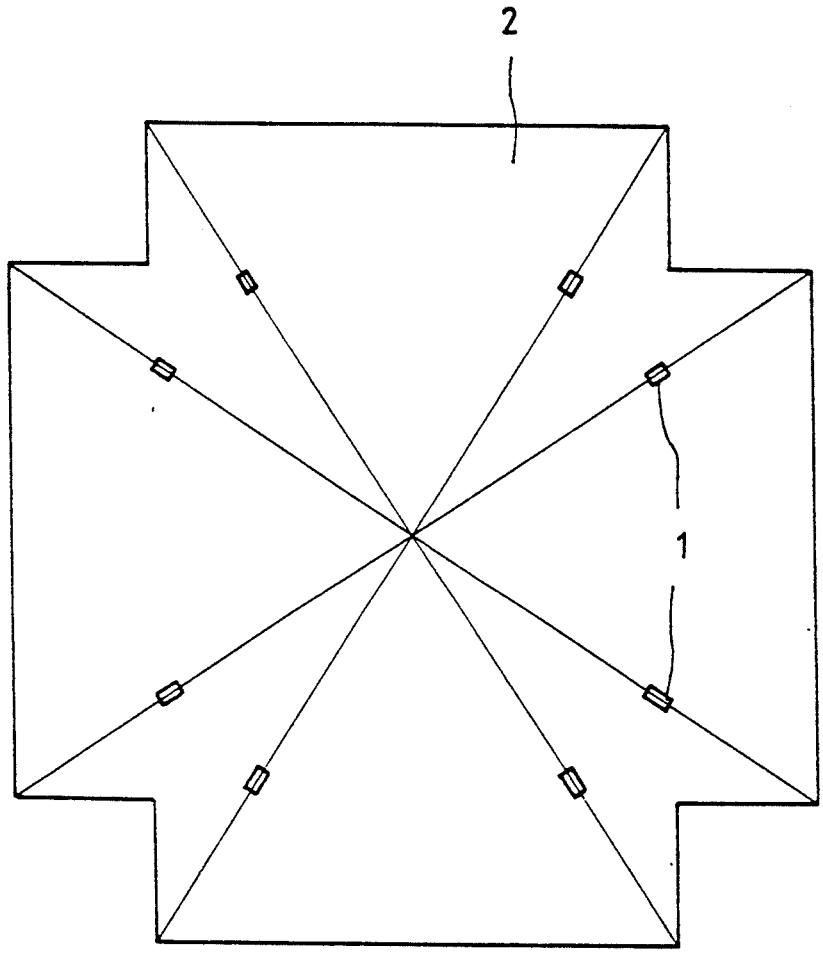
Figures 2, 9:
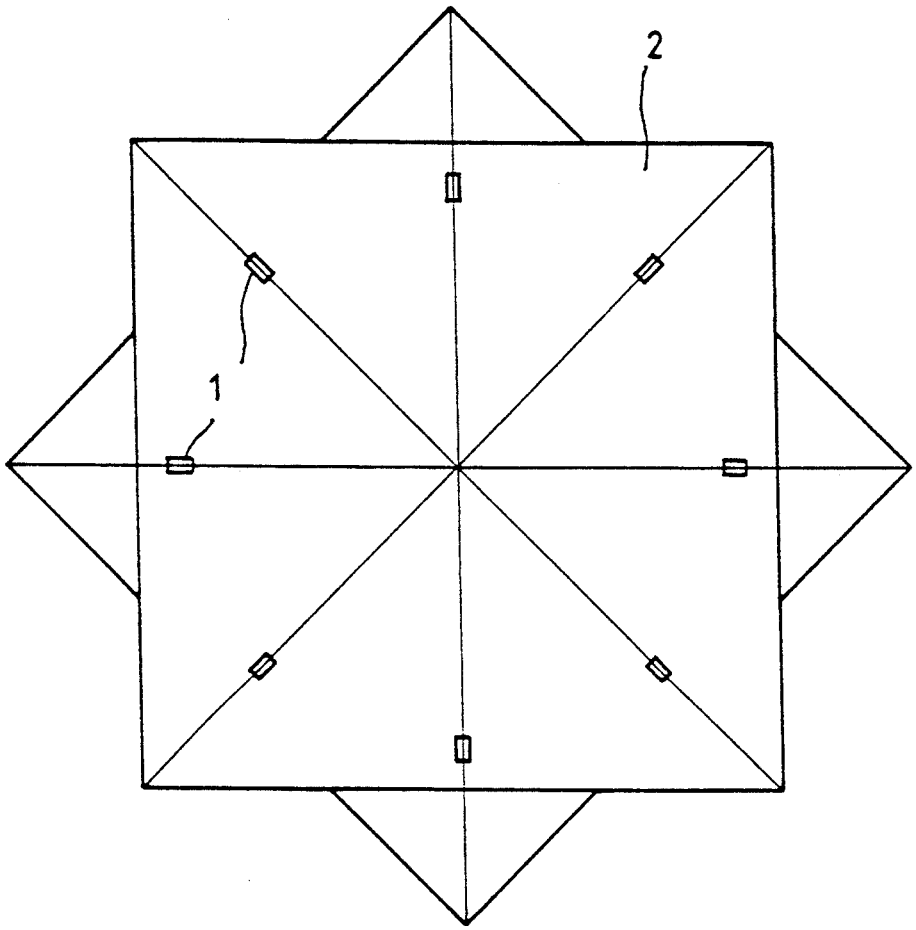
Figures 3, 9:
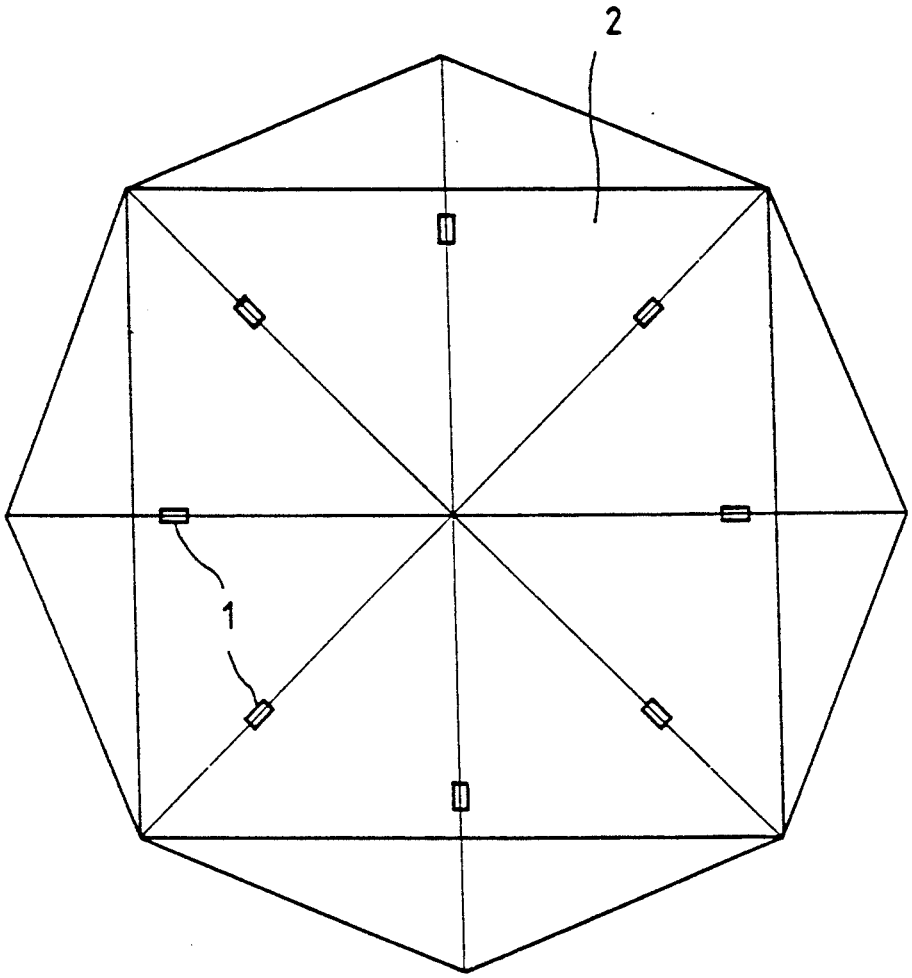
Figures 4, 9:
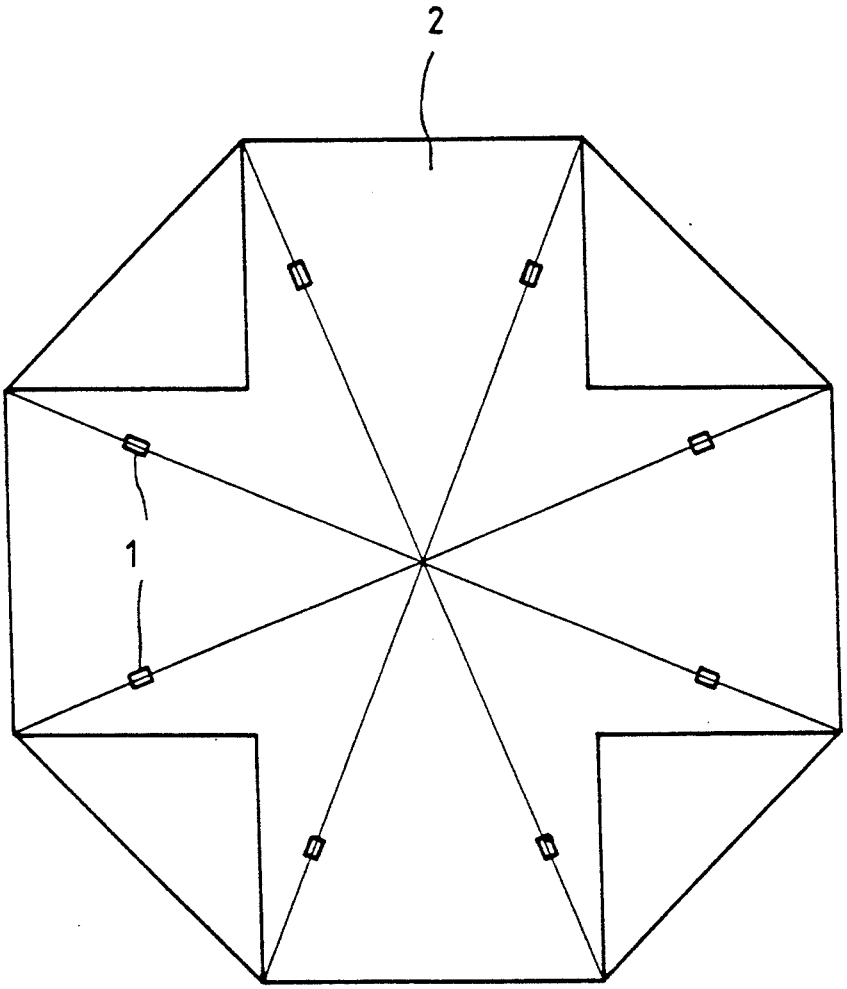
Figures 5, 9:
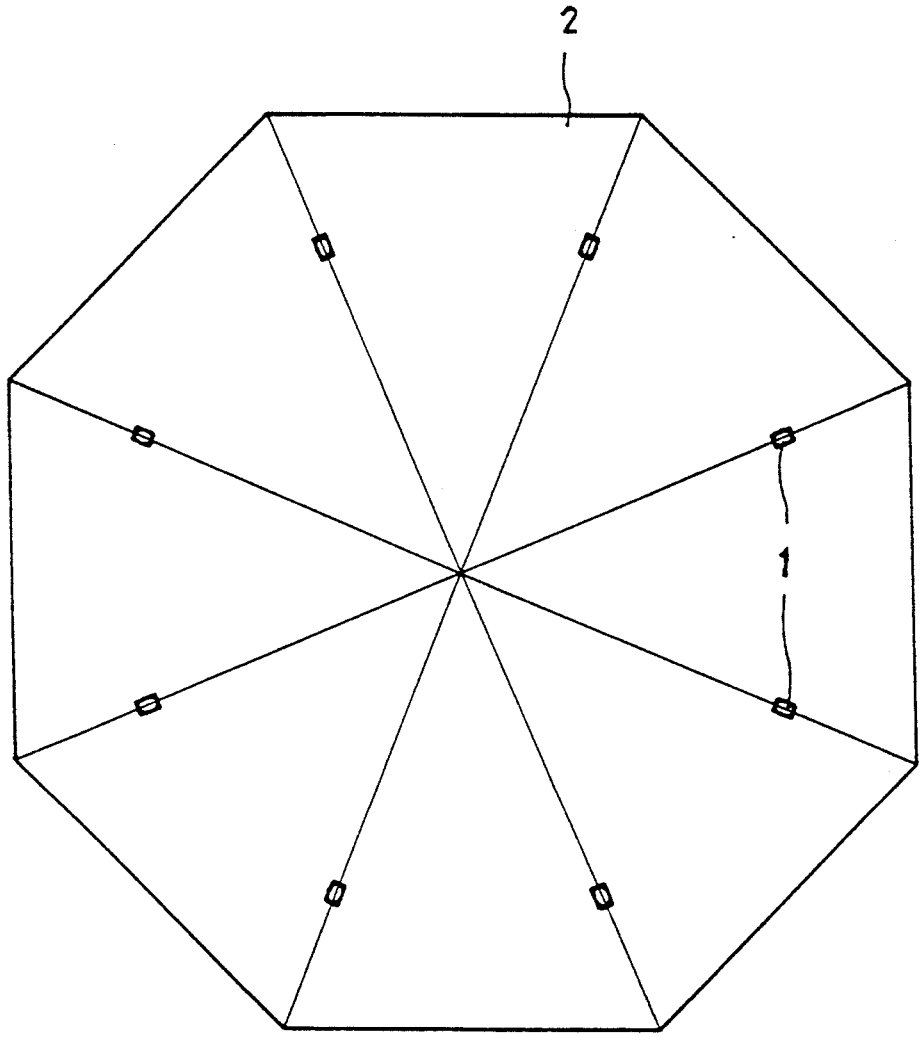

FIGS. 9, and 9-1 to 9-4 are plan views illustrating the applications of the invention in various umbrella covers. However, the invention is applicable to a conventional umbrella cover as well, as shown in FIG. 9-5.

As described above, the invention can achieve the following advantages.

(1) Some materials such as PVC can not be stitched. The strut structure of the invention, in which the umbrella cover is clamped by a specially designed fastener, enables such materials to be used as an umbrella's cover.

(2) Since a single cloth lacks tacks for sewing, an umbrella cover made of a single cloth can not be fixed on struts. With the strut structure of the invention, a single cloth may be used as the material of a folding umbrella's cover.

(3) Fasteners are integrally molded and so can be made in mass production with low cost.

(4) The strut structure is easy for assembling by directly pressing fasteners onto struts, without the demand of special skills.

(5) The umbrella cover is fixed on struts by fasteners according to the invention, without pierced holes made thereon. The strength of umbrella covers can be maintained.

From the preceding description, evidently the new designs of strut structure disclosed are practical and effective in promoting the performances of struts and umbrella production, although it does not contain abstruse theory. Therefore, we present this application for a patent grant.

What is claimed is:

1. A strut structure of a folding umbrella having a seamless umbrella cover, said strut structure comprising a strut covered with an umbrella cover, characterized in that an integrally molded plastic fastener is a hollow cylindrical body provided with an open groove on one side thereof, the outside diameter of said strut is slightly larger than the width of said groove and slightly smaller than the inner hole diameter of said fastener, said fastener is placed on said umbrella cover with the opening of said groove sitting opposite said strut and directly pressed onto said strut to fix said umbrella cover on said strut.

2. A strut structure of a folding umbrella having a seamless umbrella cover as claimed in claim 1, wherein projections are formed on said strut to hold said fastener in an engagement position and operate against longitudinal movement of said fastener.

3. A strut structure of a folding umbrella having a seamless umbrella cover as claimed in claim 1, wherein said fastener is shaped to be substantially cylindrical when a U-shaped strut with the opening facing up is used, the diameter of said cylindrical fastener being approximately equal to the width of said U-shaped groove, and said fastener being pressed into said U-shaped groove to clamp said umbrella cover thereon.

* * * * *